US007314212B2

(12) United States Patent
Higgins

(10) Patent No.: US 7,314,212 B2
(45) Date of Patent: Jan. 1, 2008

(54) SOUND ATTENUATING FENCING ASSEMBLY

(76) Inventor: William Ray Higgins, 3037 Haverhill Rd., West Palm Beach, FL (US) 33407

( * ) Notice: Subject to any disclaimer, the term of this patent is extended or adjusted under 35 U.S.C. 154(b) by 304 days.

(21) Appl. No.: 11/225,257

(22) Filed: Sep. 12, 2005

(65) Prior Publication Data

US 2007/0057242 A1 Mar. 15, 2007

(51) Int. Cl.
*E04H 17/14* (2006.01)

(52) U.S. Cl. ..... 256/19; 256/13.1; 256/24; 181/284; 181/285

(58) Field of Classification Search ..... 256/19, 256/24, 29, 13.1; 181/284, 285, 286, 290, 181/294

See application file for complete search history.

(56) References Cited

U.S. PATENT DOCUMENTS 3,726,042 A * 4/1973 Haile ..... 256/19
4,146,113 A * 3/1979 Gavel ..... 256/13.1
4,899,498 A 2/1990 Grieb
5,149,061 A 9/1992 Borgnini
5,217,771 A * 6/1993 Schmanski et al. ..... 181/284
5,404,685 A * 4/1995 Collins ..... 256/19
5,509,249 A * 4/1996 House et al. ..... 256/13.1
5,619,829 A 4/1997 Tan et al.
6,439,801 B1 * 8/2002 Galiana et al. ..... 256/13.1
6,523,807 B2 2/2003 Calverley
6,588,732 B1 7/2003 Caceres et al.
2004/0195557 A1 * 10/2004 Wall ..... 256/24
2005/0104054 A1 5/2005 Humphries et al.

* cited by examiner

*Primary Examiner*—Daniel P. Stodola
*Assistant Examiner*—Michael P. Ferguson
(74) *Attorney, Agent, or Firm*—McHale & Slavin, P.A.

(57) ABSTRACT

A deformation and weather resistant, noise attenuating fencing assembly comprises a series of hollow posts, each post formed of a fiberglass reinforced resin, having spaced apart load bearing walls defining an exterior surface, an interior surface, a first open end and a second open end. The structure-reinforcing cap is inserted within a first open end of each of the posts and frictionally engages the interior surface of the post to substantially prevent movement of the exterior surface thereof when various types of appurtenant structures are mounted thereon, which would otherwise cause deformation and possible structural failure of the post walls. First and second clips are inserted into the first and second open ends of the post, respectively, to provide an easy mechanism to properly space and secure the posts together.

8 Claims, 4 Drawing Sheets

SOUND ATTENUATING FENCING ASSEMBLY

FIELD OF THE INVENTION

This invention relates to a deformation and weather resistant, noise attenuating, fencing assembly comprising a series of hollow posts, each post having a high strength to weight ratio, which may be easily installed by an individual; most particularly to a fencing assembly effective in the attenuation of sound and which is in compliance with the Florida Building Code 2001 wind load requirements, without the need for concrete anchoring.

BACKGROUND OF THE INVENTION

Noise attenuating barriers are used extensively for blocking sounds caused by obstreperous machinery (e.g., generators), automobiles, trains, aircraft and the like. Typically, these barriers range from about 4 to 18 feet in height and are constructed of wood, metal, or concrete, with concrete being the most common. However, it has been determined that concrete and metal barriers tend to deflect sound waves rather than attenuate or absorb the same, hence, they fail to effectively prevent sound wave transmission.

While concrete and wooden posts are sturdy and can be made to provide privacy, concrete posts tend to be expensive to install and maintain, and both concrete and wooden posts deteriorate and crumble over time often leading to early failure. Attempts to overcome the deterioration problems associated with wood and concrete have included making fencing posts out of metal (e.g., steel, aluminum, etc), yet, this has proven expensive and heavy as compared to the instant invention. It is also known in the art to form sound attenuating fencing from posts made from assorted polymers for the purpose of choosing a sound absorbing material, however, these polymers lack the requisite structural properties to support heavy loads.

What the prior art has thus far failed to provide is a weather resistant, noise attenuating, fencing assembly comprising a plurality of deformation resistant poles, each formed from a fiberglass reinforced resin, in combination with clips and a structure reinforcing and weather resistant cap which provides a light-weight, easy to assemble fence having a strength to weight ratio of about 18:1. The use of fiberglass posts provides a sturdy, economical system for dampening sound waves, for example, the noise created by a generator. Furthermore, this construction makes it possible to attach approximately 800 pounds of appurtenant assemblies to each fence post weighing only about 44 pounds. As an added benefit, when the lower end of the posts are inserted about 30 to about 36" below ground, the resultant assembly meets the stringent Florida Building Code 2001 requirements for wind load without the need for additional concrete anchoring.

DESCRIPTION OF THE PRIOR ART

U.S. Pat. No. 6,588,732 to Caceres et al., disclose a fencing system having rails, slats and posts formed from pultruded fiberglass with several advantageous features. The lightweight fiberglass components are very strong and will not rust like metal fencing and do not require frequent maintenance like wood fencing. The pultruded fiberglass components are easy to manufacture and transport and the finished fence can be assembled using conventional fasteners. Fence components are designed to be lightweight while having a substantial resistance to bending forces. In addition, the fiber reinforced fencing can be made to resist degradation due to ultraviolet radiation. Unlike the instant invention, the design of the fencing system of Caceres et al., is not directed to providing a fence with any sound attenuating properties as evidenced by the embodiments that provide visibility and/or allow wind to pass through the fence slats.

U.S. Pat. No. 5,217,771 to Schmanski et al., disclose a fencing device provided to prevent the transmission of sound. The device is fabricated of a polymer composition and comprises a hollow core member formed of fiber-reinforced thermosetting resin, and an outer member formed of unreinforced thermoplastic resin that is friction fit to the core member. The core member is constructed of a thermosetting resin to provide resilience for the device. In contrast, the outer member is a thermoplastic resin used to eliminate deterioration due to weather and absorb sound waves. The inner and outer members are connected by friction. Adjacently disposed devices are connected together to form a fence-like barrier through which few or no sound waves are allowed to pass. Unlike the instant fence assembly, the posts of Schmanski et al., do not require two separate laminate substrates to provide the necessary rigidity and weather resistance provided by the instant invention. Moreover, the posts of Schmanski et al., are not composed of a fiberglass-reinforced resin veiled by a polyester cloth effective to prevent blooming of the glass fibers.

U.S. Pat. No. 4,899,498 to Grieb, discloses a highway sound barrier formed by one or more panels mounted in a vertical abutting relation, each of the panels being formed .from one or more self-supporting foam cement blocks. Each of the blocks having a foam core (e.g. extruded or expanded polystyrenes, phenolics and polyisocyanurate forms), a reinforcement grid mounted on the exposed surfaces of the core and a thin fiberglass coating applied to the reinforced grid for securing the grid to the foam core and to increase the compressive strength of the blocks. The addition of cementitious or thermal barrier coatings to the foam blocks develops strong load bearing strengths. These coatings can be made sun resistant, frost-free and non-cracking. The thickness of the blocks being sufficient to form a load bearing structure. Unlike the instant fence assembly, the panels of Grieb must anchored to the ground by a helical screw anchor rod embedded in a concrete pad.

U.S. Pat. No. 5,149,061 to Borgnini, discloses a panel with a horizontal or vertical transverse ridged cross-section, that can be interconnected in succession with other panels or the same type to form a continuous screen which is installed above the central barrier separating the two carriage-ways of a road, or above the barriers that delimit the sides of a road; this screen, particularly when installed above the central barrier of a road, being designed to be capable of simultaneously acting to screen off full beam headlamps and spray from wet road surfaces from the opposing carriageways of a road, and to act as reference at night and/or in conditions of poor visibility, due to the high refractive power of its surfaces.

U.S. Pat. No. 5,619,829 to Tan et al., disclose a sound insulating wall and method of installing the same. Fixing members are mounted, at predetermined intervals, on the top portion of a footing that is built along a road. A concrete-type board having vertical through-holes is mounted on the footing through the fixing member. Steel rods each having top and bottom threaded portion are inserted into the respective through-holes of the board with the bottom threaded portion being threadedly engaged with the respective fixing members. Upper nuts are engaged with the top threaded portion of the respective rods, to thereby fix the board onto the footing.

All of the aforementioned prior art fail to disclose a weather and deformation resistant fence assembly having a high strength to weight ratio, which may be easily installed by an individual, and which are in compliance with the Florida Building Code 2001 wind load requirements, without the need for concrete anchoring.

All patents and publications listed herein are hereby incorporated by reference in their entirety to the same extent as if each individual publication was specifically and individually indicated to be incorporated by reference.

SUMMARY OF THE INVENTION

Consequently, in response to the aforementioned problems found in the prior art, the present invention discloses a noise attenuating, weather and deformation resistant fencing assembly comprising a series of hollow posts, each post formed of a lightweight fiberglass-reinforced resin. The assembly includes a structure-reinforcing cap inserted within a first open end of each of the posts to frictionally engage the interior surface of the post to substantially prevent movement of the exterior surface thereof when various types of appurtenant structures are mounted thereon, which would otherwise cause deformation and possible structural failure of the post walls. The assembly further includes first and second clips that are inserted into the first and second open ends of the post, respectively, to provide an easy means to properly space and secure the posts together.

In a preferred embodiment the assembly includes a fiberglass post which is weather resistant, thereby providing a longer life cycle than concrete, wood or metal and in a particularly preferred embodiment includes a UV inhibitor for protection from ultraviolet light degradation.

Assembly of the post, clip and cap yield a sound attenuating, deformation and wind resistant assembly having an enhanced structural properties. As opposed to prior art devices that often required multiple individuals for installation, the fencing assembly of the present invention only requires a single individual for installation. Furthermore, direct burial at a depth of about 30 to about 36" is in compliance with Florida Building Code 2001 wind load requirements.

Accordingly, it is a primary objective of the instant invention to provide a weather resistant and sound insulating fencing assembly comprising a deformation resistant pole, formed from a fiberglass reinforced resin, in combination with a structure reinforcing cap and clips which, upon assembly, provides an structure having a strength to weight ratio of about 18:1.

Another objective of the instant invention is to provide a fencing assembly whereby certain selective posts can be turned to create an aesthetically attractive fencing system.

It is a further objective of the instant invention to provide a deformation resistant assembly capable of meeting Florida Building Code 2001 Wind Load Requirements, without the need for concrete anchoring.

It is yet another objective of the instant invention to provide poles, which are lightweight, economical, sturdy, and can be readily manufactured and transported.

It is still further objective of the present invention to provide ultraviolet degradation resistance to the fencing assembly.

Another objective of the present invention to provide a fencing assembly that may be installed by an unskilled person using few hand tools.

It is yet another objective of the instant invention to provide a post incorporating therein a veil effective to prevent blooming of the glass fibers.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
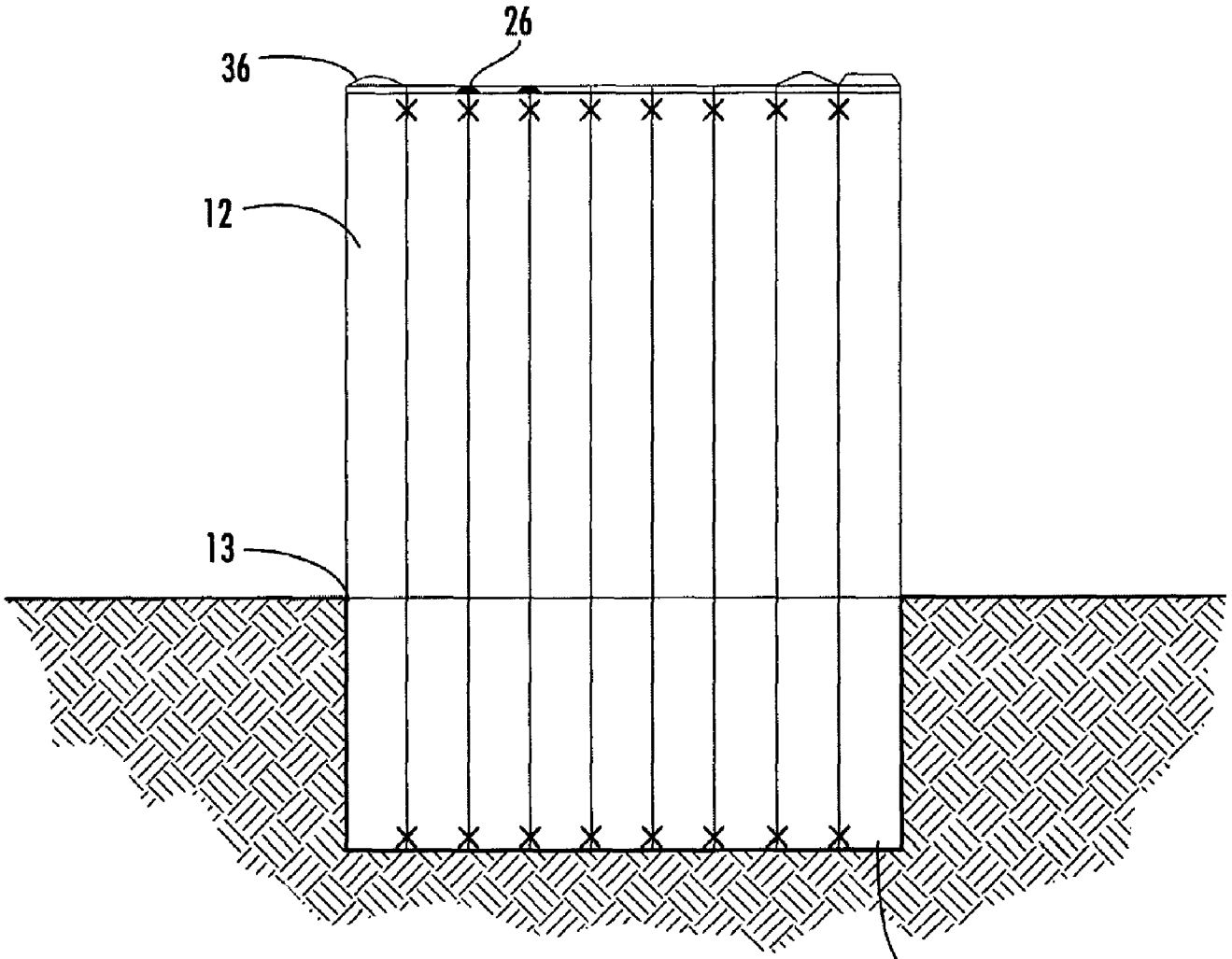
FIG. 1 is a front view of the fencing assembly of the instant invention.

Referring now to FIGS. 1-4, wherein like elements are numbered consistently throughout, FIG. 1 shows a cross-sectional view of a deformation resistant, sound attenuating fencing assembly 10 comprising a plurality of hollow posts 12 formed of a fiberglass reinforced resin installed in the ground 13. Fiberglass reinforced resin is utilized herein for both its palatial acoustical absorption properties and structural integrity. In a preferred embodiment, the post is formed from an isophthalic polyester resin having a UV inhibitor incorporated therein and containing greater than 50% glass by weight, in a particularly preferred embodiment the post contains from about 56.5% to about 61% glass by weight.

In order to prevent blooming, a condition wherein the ends of the glass fibers protrude from the polyester resin matrix, the instant post is formed with an integral polyester veil. This veil is a polyester cloth molded to the pole's surface during manufacture, wherein it is intrinsically bound to the surface by intermingling with the polyester resin. The veil thus encapsulates the fiberglass and prevents blooming.

Figure 2:
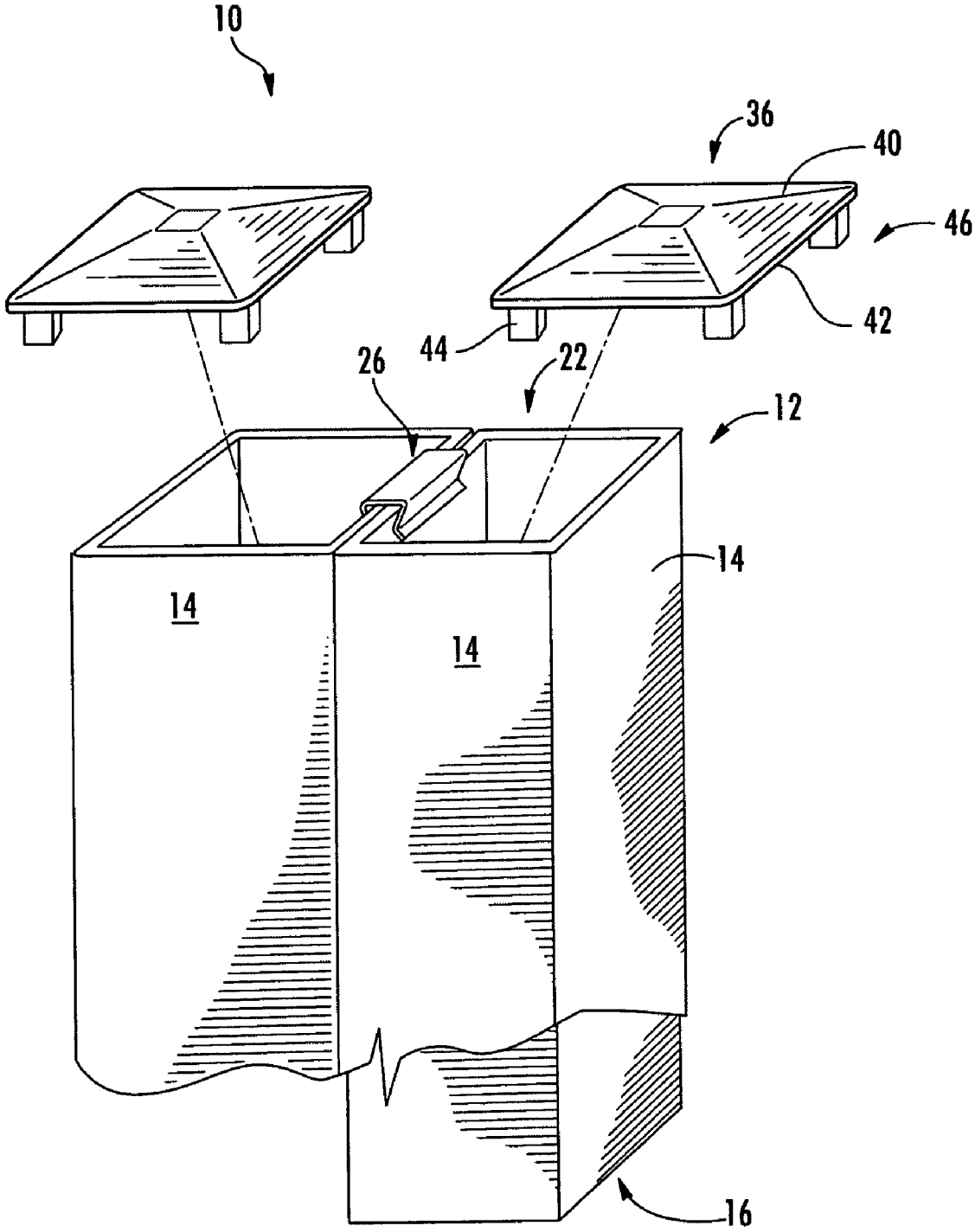
FIG. 2 is a partial, upper perspective view of the fencing assembly of the instant invention illustrating a clip for attaching adjacent posts together.

As seen in FIG. 2, each post 12 has a pair of spaced apart load bearing walls 14 defining an exterior surface and a hollow interior surface. The post includes a first open end 22 and a second open end 16, respectively. The hollow interior of the posts also provides enhanced attenuation of sound and increased portability.

Figure 3:
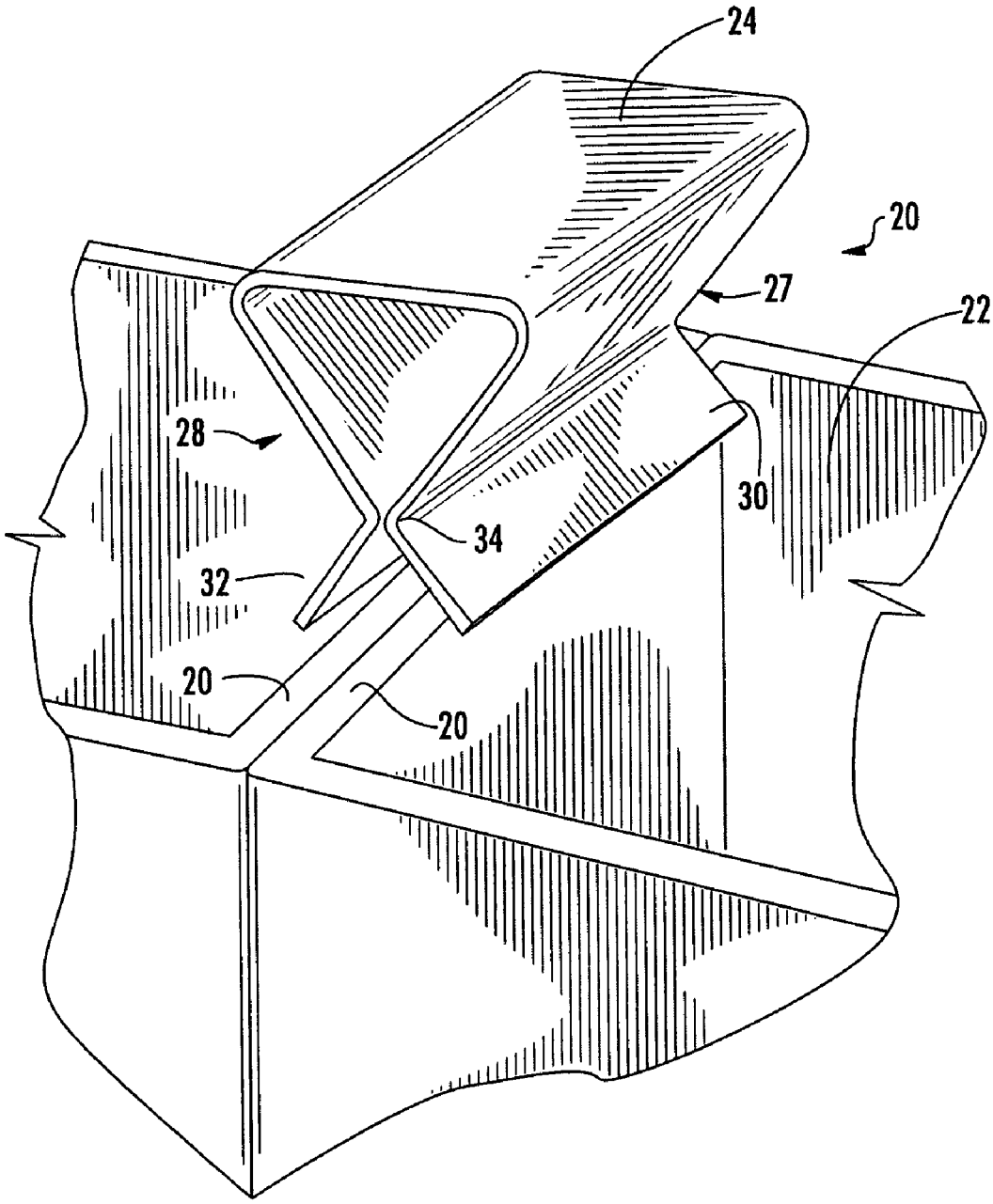
FIG. 3 is a detailed view of the clip used for attaching adjacent posts together.

The posts of the fencing assembly are releasably attached to each other at the first and second opens end of the post by first and second clips 26, respectively, shown in detail at FIG. 3. Each clip includes a substantially planar surface 24 with two integrally attached arms 27, 28 located on opposite sides of the planar surface and bent inwardly and biased toward each other. Upon installation, each inwardly biased arm of the clip separated such that each arm can be inserted into the first open ends of two neighboring posts (FIG. 2), causing the arms to frictionally engage the interior surface of one of the load bearing walls, thereby forcing the posts toward each other. This insures the posts are closely adjoined such that there is little space there between, resulting in substantially little acoustical transmission therethrough. This method of attaching posts is advantageous as it avoids creating holes for attachment through the walls 14, which can reduce the post's sound attenuating performance.

In a preferred embodiment, shown in FIG. 3, the arms of the clips include outwardly extending members 30, 32 effectively angled to help guide the arms over the thickness of two adjacent post walls at the open ends of two adjacent posts, while the user provides a force perpendicular to the planar surface 24, typically by a hammer or the like. This allows the walls of the post to forcibly separate the inwardly biased arms to such an extent that each arm can be simultaneously inserted into the open ends of two neighboring posts, whereby a portion of each of the arms 34 contact the interior surfaces of the walls and provides lateral force that causes them to clamp the interior surfaces the load bearing walls together. The user will continue to force the clip arms into the hollow interior of the posts until the lower surface of the planer member is in contact with the edges 20 of adjacent posts walls.

During installation of the fencing assembly, either the first or second clips may be inserted into the first or second end of the posts, however, it is preferred that the second clips be first inserted into the second ends of adjacent posts to connect them. The adjoined posts are at least partially buried and the first clips inserted into the first ends the adjacent posts for reinforced structural stability.

As shown in FIGS. 1-2, the fencing assembly includes a plurality of structure reinforcing caps 36, which may be formed from any suitable polymeric resin, for example, polypropylene, a high-density polyethylene or fiberglass reinforced nylon. The cap is constructed and arranged for insertion within the first open end of the post. In a particularly preferred embodiment, the cap is formed from a reinforced, high rigidity, UV stabilized polypropylene.

In one embodiment, the cap includes a pyramidal shaped crown 40 with a bottom surface 42 having downward depending members 44 integrally connected thereto which act as a retention means. The cap members 44 are constructed and arranged to frictionally engage the interior surface of the post and substantially prevent movement of the exterior surface thereof when various types of appurtenant structures are mounted thereon utilizing through-bolts or the like, which would otherwise cause deformation and possible structural failure of the post walls. Preferably, the depending members 44 are located along the bottom surface 42 such that when the cap 36 is installed on the first open end of the post the members 44 do not engage the clip 26, which could potentially prevent the cap from effectively engaging the interior surface of the post.

Other, various retention means are contemplated by the instant invention for fixedly retaining the structure-reinforcing cap within the hollow rectangular post. Other embodiments of the retention means include screws 46, rivets, bolts or the like known to those skilled in the art, which are applied so as to simultaneously engage the cap (including cap members 44) and the load bearing walls whereby removal of the cap is prevented. Such attachment insures retention of the cap within the post, thus enabling the load bearing walls to be maintained in a spaced apart position subsequent to mounting thereon items having a weight up to 18 times the weight of post. In prior art devices, mounting is generally accomplished by the use of through bolts, which upon tightening, would have deformed and cracked the post. Owing to the cooperation of the structure reinforcing cap and hollow post, the instant invention provides a solution to this problem. While the structure-reinforcing cap need not completely seal the open end, in a preferred embodiment it does provide closure to the first open end.

Figure 4:
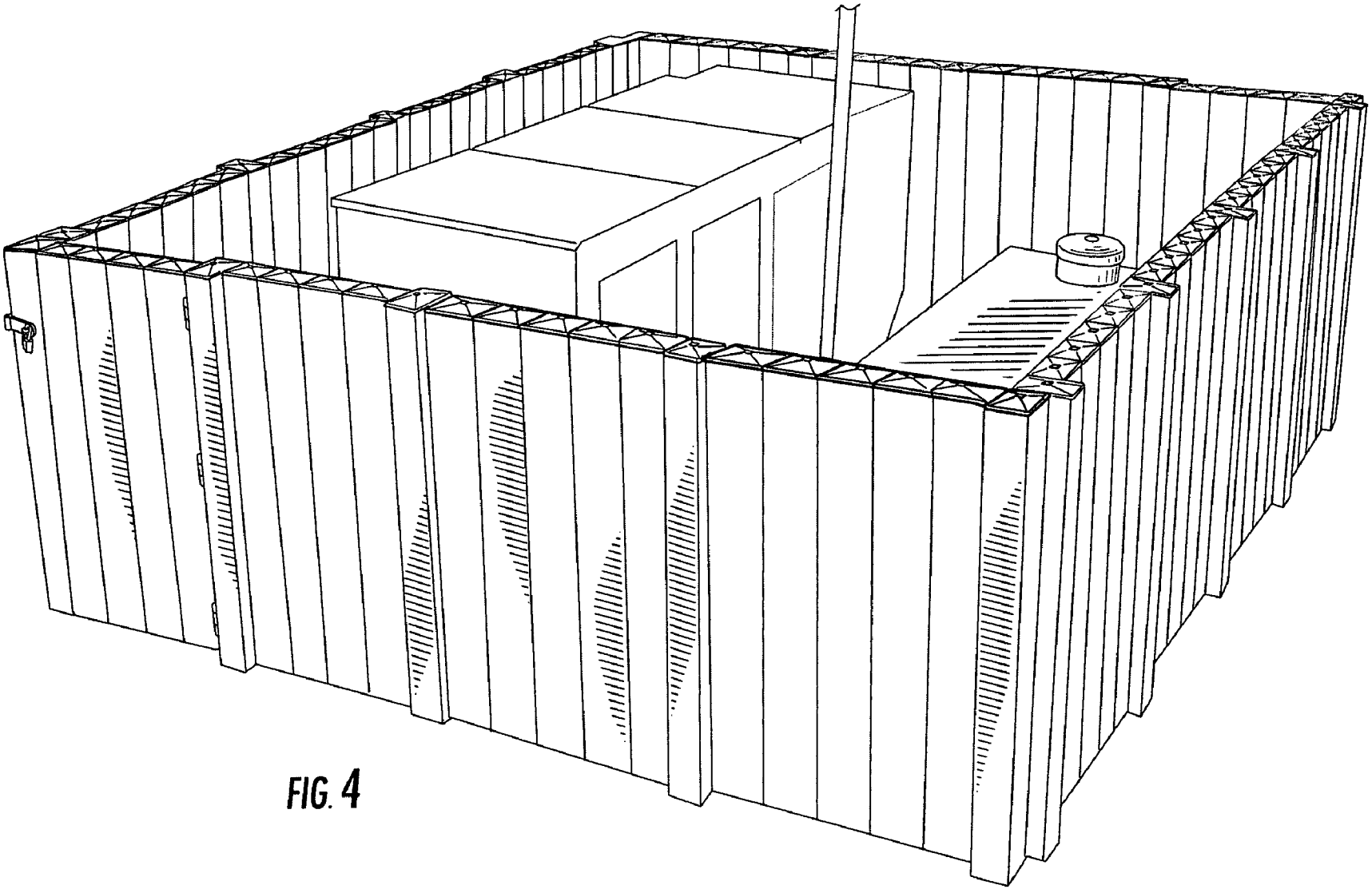
FIG. 4 illustrates one embodiment of the instant fencing assembly surrounding a generator with certain selective posts turned perpendicular to the rest to create an aesthetically attractive fencing system.

FIG. 4 illustrates one embodiment of the fencing assembly utilized to attenuate the noise created by a generator. The posts in the embodiment comprise a rectangular cross-section with certain selective posts turned perpendicular to the rest to create an aesthetically attractive fencing system.

While the posts may be of any shape, as illustrated herein, preferably, the post is either a square or a rectangle. The posts are designed for direct burial, such that the post may be implanted directly into the ground, without the need for concrete reinforcement, preferably at a depth of about 30"-36" below the ground level, and provide above ground support to one or more appurtenant structures attached thereto, so as to enable above-ground placement of loads up to 18 times the weight of the pedestal assembly.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A deformation and weather resistant, noise attenuating fencing assembly comprising:

a series of hollow rectangular posts, each of said posts formed of a polyester cloth veiled fiberglass reinforced resin, said posts having a pair of spaced apart load bearing walls defining an exterior surface, an interior surface, a first open end and a second open end;

a first metallic clip having a substantially planar surface including two integrally formed arms biased toward each other and extending on each side of said planar surface, whereby said each biased arm is inserted into said first open ends of two adjacent posts causing them to frictionally engage said interior surface of said load bearing walls of said posts, forcing them toward each other;

a second metallic clip having a substantially planar surface including two integrally formed arms biased toward each other and extending on each side of said planar surface, whereby said each biased arm is inserted into said second open ends of said two adjacent posts causing them to frictionally engage said interior surface of said load bearing walls of each of said posts, forcing them toward each other;

a structure reinforcing cap, constructed and arranged for attachment within said first open end having said first clip inserted therein, whereby said attachment causes said structure reinforcing cap to frictionally engage said interior surface of said post and substantially preclude movement of said exterior surface; and at least one retention means constructed and arranged for retaining said cap within said post;

whereby said joined posts provide a fencing assembly having substantially no space between them for enhanced sound attenuation and privacy and each said post capable of having a weight up to 18 times the weight of said post attached to thereto.

2. The fencing assembly of claim 1 wherein said cap provides closure to said first open end and prevents water ingress therein.

3. The fencing assembly of claim 1 wherein said at least one retention means include a plurality of fasteners for simultaneously engaging said cap and said load bearing walls whereby removal of said cap is prevented.

4. The fencing assembly of claim 1 wherein said post includes at least one additive to provide resistance to ultraviolet radiation.

5. The fencing assembly of claim 1 wherein said cap includes at least one additive to provide resistance to ultraviolet radiation.

6. The fencing assembly of claim 1, wherein said resin is an isophthalic polyester resin comprising a UV inhibitor and at least 50% glass by weight.

7. The fencing assembly of claim 6, wherein said isophthalic polyester resin comprises from about 56.5% to about 61% glass by weight.

8. A process for providing a deformation and weather resistant, noise attenuating fencing comprising:

providing a plurality of hollow rectangular posts, each formed of a polyester cloth veiled fiberglass reinforced resin, each said post having a pair of spaced apart load bearing walls defining an exterior surface, an interior surface, a first open end and a second open end;

inserting a first clip having a substantially planar surface including two integrally formed arms biased toward each other and extending on each side of said planar surface, whereby said each biased arm is inserted into said first open ends of two adjacent posts causing them to frictionally engage said interior surface of said load bearing walls of said posts, forcing said posts toward each other;

inserting a second clip having a substantially planar surface including two integrally formed arms biased toward each other and extending on each side of said planar surface, whereby said each biased arm is inserted into said second open ends of said two adjacent posts causing them to frictionally engage said interior surface of said load bearing walls of said posts, forcing them toward each other, wherein said adjacent posts are securely joined together after insertion of said first and second clips;

attaching a structure reinforcing cap, constructed and arranged for insertion within said first open end having said first clip inserted therein, whereby said insertion causes said structure reinforcing cap to frictionally engage said interior surface of said post and substantially prevents movement of said exterior surface and at least one retention means constructed and arranged for retaining said cap within said post; and directly implanting said joined posts within the ground to a depth of between about 30" and 36";

whereby said joined posts provide a fencing assembly having substantially no space between them for enhanced sound attenuation and privacy and each said post capable of having a weight up to 18 times the weight of said post attached to thereto.

* * * * *